US006257702B1

(12) United States Patent
Blunden Kenyon

(10) Patent No.: US 6,257,702 B1
(45) **Date of Patent: *Jul. 10, 2001**

(54) METHOD AND APPARATUS FOR PROTECTING ELECTRONIC CONTACTS ON PRINTER INK CARTRIDGES DURING INSERTION TO AND REMOVAL FROM A PRINTER

(75) Inventor: Robin George Blunden Kenyon, Woolloomooloo (AU)

(73) Assignee: Calidad Distributors PTY Ltd., New South Wales (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/159,339

(22) Filed: Sep. 23, 1998

(30) Foreign Application Priority Data

Oct. 1, 1997 (AU) ..... PO9565

(51) Int. Cl.[7] ..... B41J 2/01

(52) U.S. Cl. ..... 347/49; 347/50

(58) Field of Search ..... 347/86, 29, 33, 347/49, 50; 206/45, 23, 385, 462; 428/31

(56) References Cited

U.S. PATENT DOCUMENTS

| | | | | |
|---|---|---|---|---|
| 5,279,410 | * | 1/1994 | Arashima et al. | 206/45.14 |
| 5,368,903 | * | 11/1994 | Trier | 428/31 |
| 5,392,063 | * | 2/1995 | Rhoads | 347/49 |
| 5,598,194 | * | 1/1997 | Hall et al. | 347/50 |
| 5,701,995 | * | 12/1997 | Higuma et al. | 206/205 |
| 5,864,348 | * | 1/1999 | Fritsch et al. | 347/22 |

* cited by examiner

*Primary Examiner*—N. Le
*Assistant Examiner*—Anh T. N. Vo
(74) *Attorney, Agent, or Firm*—Ladas & Parry

(57) ABSTRACT

Disclosed is a method and apparatus for protecting electronic contacts on printer ink cartridges during insertion to and removal from a printer. The method includes inserting a protective strip (10) into the cradle (18) of the printer such that at least a portion of the strip resides between the electronic contacts during removal or insertion of the cartridge (15).

16 Claims, 3 Drawing Sheets

METHOD AND APPARATUS FOR PROTECTING ELECTRONIC CONTACTS ON PRINTER INK CARTRIDGES DURING INSERTION TO AND REMOVAL FROM A PRINTER

BACKGROUND OF THE INVENTION

The invention relates to a method of protecting the electronic contacts on an ink cartridge as used for example in an ink jet printer. The invention also relates to a protector strip for use in protecting the electronic contacts on an ink cartridge.

Ink cartridges for use in ink jet printers are designed to be used once and discarded when the ink is depleted and replaced by a new cartridge.

It is known to remove the ink cartridges from the printer and refill the cartridges with ink for reuse. However, upon removal from, and insertion to the printer, the electronic contacts on the ink cartridge are subject to wear and do not provide a proper electronic contact. Where a proper electronic contact is not made, the computer software operating the printer often displays an error message, incorrectly indicating that an incompatible cartridge has been inserted. In order then to operate the printer, a new ink cartridge must be purchased. These cartridges are quite expensive.

OBJECT OF THE INVENTION

It is the object of the present invention to overcome or substantially ameliorate the above disadvantages and/or more generally to provide a method and apparatus for protecting the electronic contacts on an ink cartridge for use in an ink jet printer or the like.

SUMMARY OF THE INVENTION

There is disclosed herein a method of protecting electronic contacts on an ink cartridge during removal of the cartridge from a cradle in a printer having corresponding electronic contacts, the method comprising the steps of:

inserting a protective strip into the cradle such that at least a portion of the strip is between the electronic contacts of the cartridge and the printer, and unloading the cartridge from the cradle.

Preferably, the method further comprises the step of:

opening a latch on the ink cartridge prior to inserting the protective strip into the cradle.

There is further disclosed herein a method of protecting electronic contacts on an ink cartridge during insertion of the cartridge to a cradle in a printer, the method comprising the steps of:

inserting a protective strip into the cradle such that at least a portion of the protective strip is positioned such that once the cartridge is inserted into the cradle, that portion will be between the electronic contacts on the cartridge and in the printer, and inserting the cartridge into the cradle.

Preferably, the method further comprises the step of:

removing the protective strip from the cradle.

Preferably, the method further comprises the step of:

closing a cartridge latch upon the ink cartridge.

There is further disclosed herein a protective strip for use in protecting electronic contacts on an ink cartridge during removal from and insertion to a printer, the protective strip being formed of substantially smooth, self-supportive material having a length of at least about 12 cm and a width of about 2 cm. Alternatively, the width might be about 3 cm.

Preferably, the strip has a thickness in the range of 0.2 to 0.3 mm.

Preferably, the strip is non-metallic.

Preferably, the strip is formed of PVC or other plastic material.

There is further disclosed herein a package for an ink cartridge refilling kit, at least a portion of the package comprising substantially smooth, self-supportive material, which portion comprises an outline or line of weakness defining the shape of a protective strip to be removed from the portion for use in protecting electrical contacts of an ink cartridge during removal and/or reinsertion to a cradle in a printer.

Preferably, the line of weakness comprises perforations.

Alternatively, the line of weakness is of reduced thickness as compared to the thickness of the material in said portion.

Preferably, the shape of a protective strip defined by the outline or line of weakness is about 12 cm long and has a width of about 2 or 3 cm.

Preferably, the portion of the package comprising substantially smooth, self-supportive material has a thickness in the range of 0.2 to 0.3 mm.

BRIEF DESCRIPTION OF THE DRAWINGS

Preferred forms of the present invention will now be described by way of example with reference to the accompanying drawings, wherein.

DETAILED DESCRIPTION OF THE PREFERRED EMBODIMENTS

Figure 1:
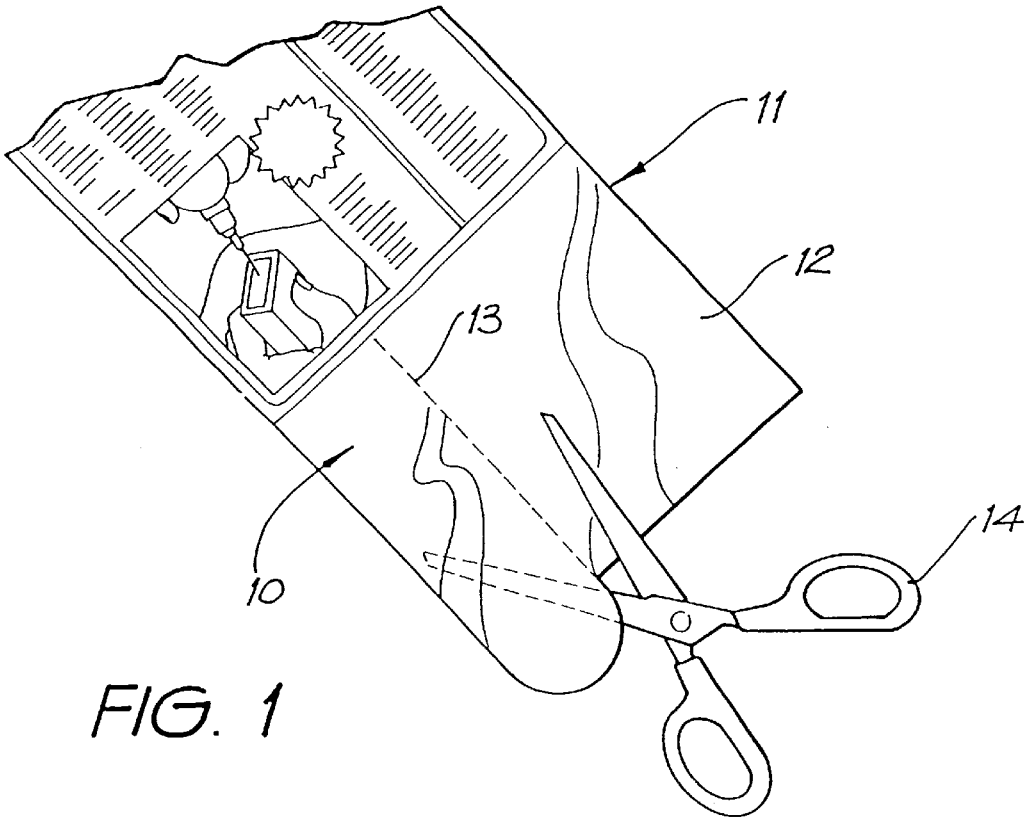
FIG. 1 is a schematic diagram showing a strip about to be cut from a package of an ink cartridge re-filling kit.

In FIG. 1 of the accompanying drawings there is schematically depicted an ink cartridge re-filling kit package 11 comprising a plastic portion 12 having a line of weakness 13 delimiting that portion 12 from a protective strip 10 which can be cut along the line of weakness 13. The line of weakness 13 might comprise perforations or a line of reduced thickness. As an alternative, a printed line might simply be provided as a guide for cutting by scissors 14.

Figure 4:
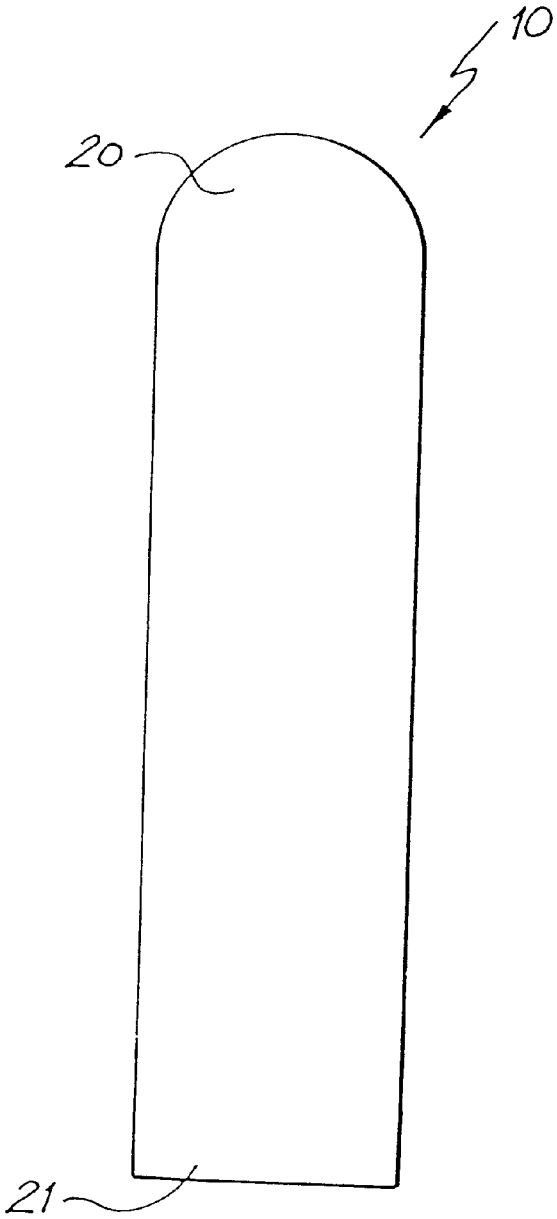
FIG. 4 is a schematic plan view of a protective strip.
Figure 5:
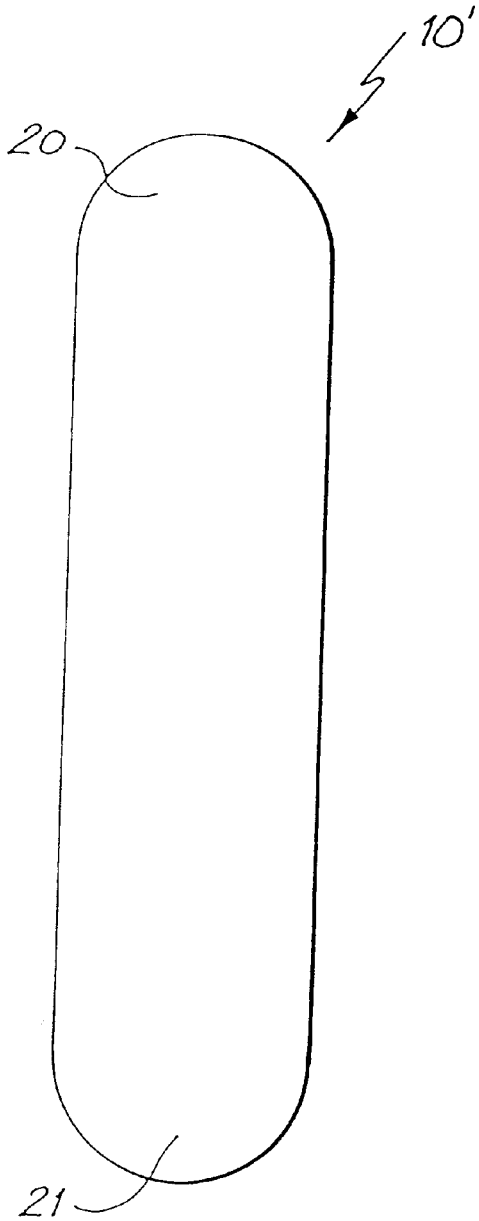
FIG. 5 is a schematic plan view of another protective strip.

As shown in FIG. 4, the protective strip 10 comprises an upper grasping portion 20 having a curved upper edge. The shape of this upper edge is not critical. The opposite end 21 of strip 10 comprises a straight bottom edge. Alternatively, and as shown in FIG. 5, a protective strip 10' can comprise two ends 20 and 21, each having a curved edge.

Figure 2:
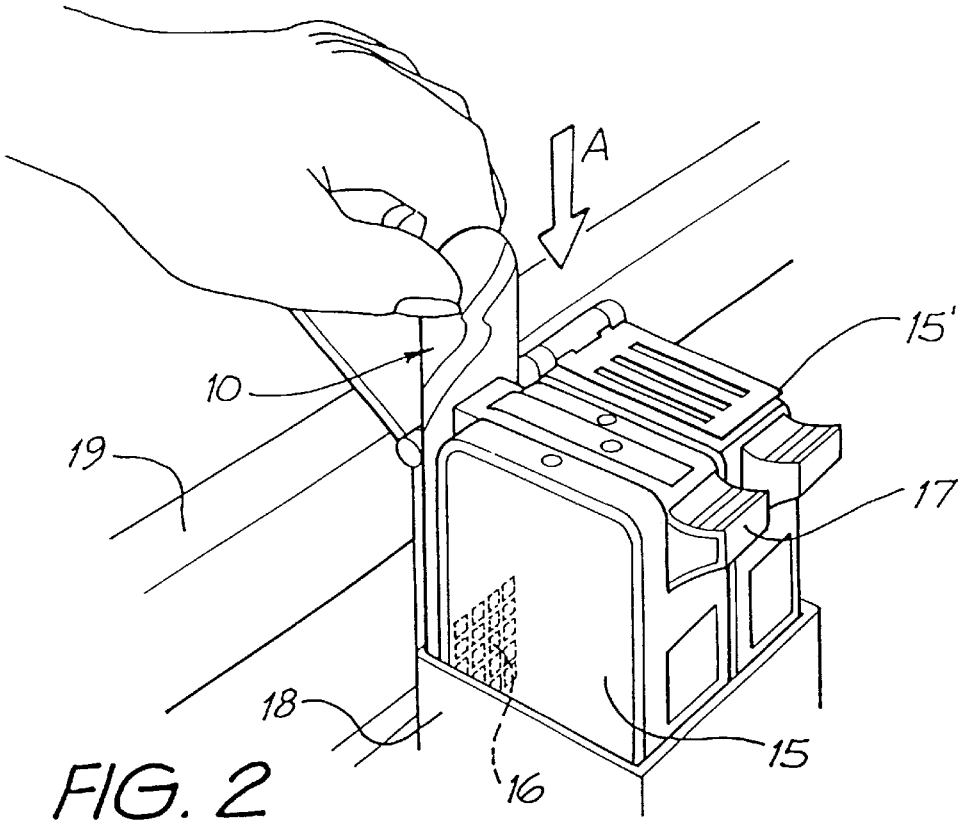
FIG. 2 is a schematic illustration showing a protective strip being inserted into the cradle of a printer alongside electronic contacts of an ink cartridge.

In FIG. 2 there is schematically depicted a pair of ink cartridges 15 and 15' located within a cradle 18 of a printer 19. One, two or more cartridges 15 can be provided, depending on whether the printer prints in black or multiple colours. Typically, in a black ink printer, one cartridge is provided, whereas in a color printer, two, three or more cartridges are provided. Cartridge 15 comprises a plurality of electronic contacts 16 which engage with corresponding contacts in the printer 19. Ordinarily, during removal and reinsertion of the cartridge 15, the cartridge contacts are easily eroded by interaction with the printer contacts.

To avoid this erosion, the protective strip 10 is inserted into the cradle 18 in a downward direction as indicated by arrow A until the lower extremity of the protective strip 10 abuts against the bottom of the cradle 18. Prior to insertion of the protective strip 10, the cartridge handle 17 is lifted.

Once the protective strip 10 is in place, the cartridge 15 is unloaded.

Figure 3:
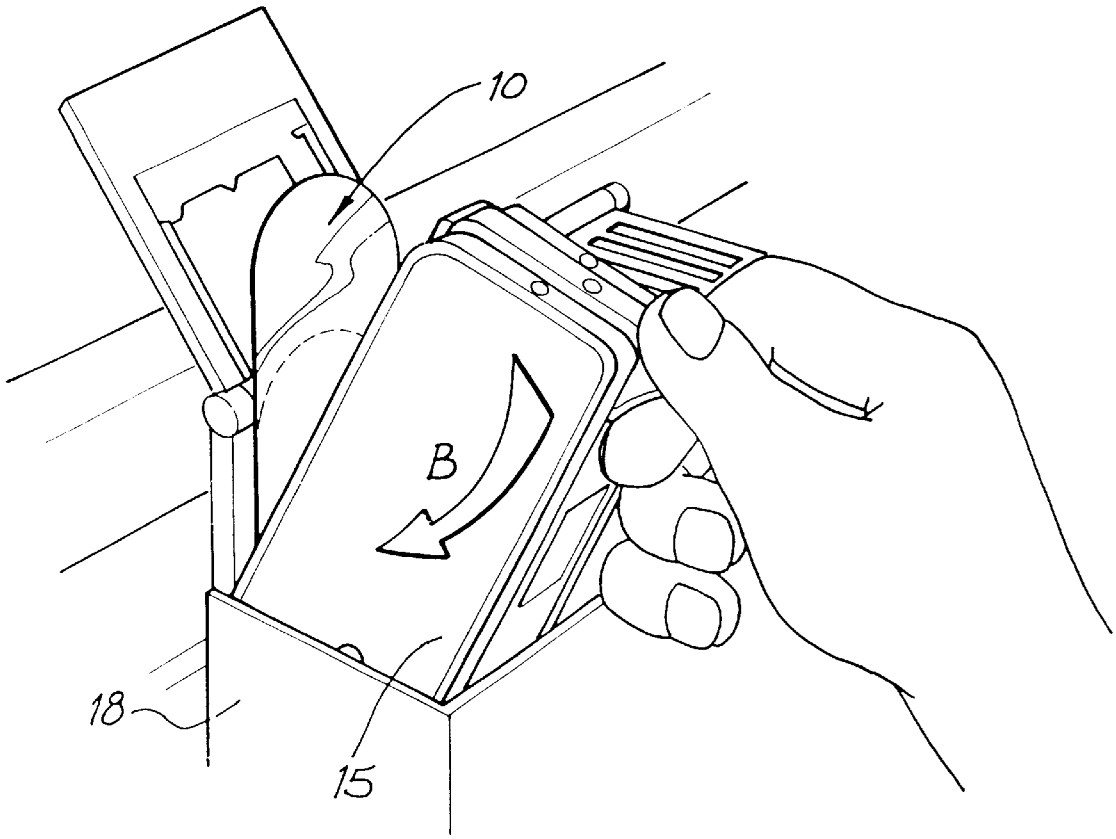
FIG. 3 is a schematic illustration showing reinsertion of an ink cartridge into the printer cradle with the protective strip in place.

Once the cartridge has been re-filled with ink of an appropriate color, it is then reinserted into the cradle 18 with the protective strip 10 in place as shown in FIG. 3. The protective strip 10 can be cleaned to remove any ink spillages therefrom prior to reinsertion to the position shown in FIG. 3 and reinsertion of the cartridge 15.

Once the steps are completed, the protective strip 10 can be withdrawn to allow electronic contact to re-establish between the contacts 16 and the corresponding contacts in the printer 19.

As an alternative to removing the protective strip 10 from portion 12 of package 11, a separate protective strip can be packaged with the re-inking kit. The strip 10, whether formed as part of the portion 12 or formed separately, would typically be of a minimum length of 12 cm and a typical width of about 2 cm or 3 cm depending on the make and model of the ink cartridge.

The thickness of the protective strip 10 is typically about 0.2 to 0.3 mm. The protective strip 10 might be formed of PVC plastic material, Teflon, nylon, cardboard or other self-supportive, smooth, preferably non-metallic material which is substantially non-abrasive to the electronic contacts 16.

It should be appreciated that modifications and alterations obvious to those skilled in the art are not to be considered as beyond the scope of the present invention. For example, and for use with a color printer comprising three separate cartridges, a triple-strip 10 might be provided comprising a plurality of fingers extending from a common base portion, each finger being dimensioned equivalently to strip 10 disclosed above. Also, it should be appreciated that the length of strip 10, being 12 cm at least, might be varied, depending on the dimension of the ink cartridge 16. As exemplified, 12 cm leaves an exposed area sufficient to be grasped by a user as shown in FIG. 2. Furthermore, the width of each strip 10 should be broad enough to cover the electronic contacts, but not so broad as to not fit within the cradle. Also, the thickness of the strip 10 should be sufficient to be self-supportive, though not so thick as to fail with the electronic contacts during insertion of the strip into cradle 18. Furthermore, the strip 10 could be formed of cardboard or any other non-metallic material having a degree of rigidity sufficient for the task.

What is claimed is:

1. A method of protecting electronic contacts on an ink cartridge during removal of the cartridge from a cradle in a printer having corresponding electronic contacts, the method comprising the steps of:

inserting a protective strip into the cradle such that at least a portion of the strip resides between the electronic contacts on the ink cartridge and the corresponding electronic contacts on the printer, and unloading the cartridge from the cradle while said strip remains in said cradle.

2. The method of claim 1 further comprising the step of:

lifting a handle on the ink cartridge prior to inserting the protective strip into the cradle.

3. The method of claim 1, wherein said protective strip is formed of substantially smooth, self supportive, non-magnetic material having a length of at least 12 cm and a width of 2 to 3 cm.

4. The method of claim 3, wherein said strip is formed with a thickness between 0.2 and 0.3 mm.

5. The method of claim 3, wherein said strip is made of plastic material.

6. The method of claim 3, wherein said protective strip is removed from a package along a separation line defining the shape of the strip and thereafter inserted into the cradle.

7. The method of claim 6, wherein said separation line is formed by perforations.

8. The method of claim 6, wherein said separation line is formed by a reduced thickness of material.

9. A method of protecting electronic contacts on an ink cartridge during insertion of the cartridge in a cradle in a printer having corresponding electronic contacts, the method comprising the steps of:

inserting a protective strip into the cradle such that at least a portion of the protective strip is positioned such that once the cartridge is inserted into the cradle, said portion of the protective strip will reside between said electronic contacts on the ink cartridge and the corresponding electronic contacts of the printer, and inserting the cartridge into the cradle while said strip remains in said cradle.

10. The method of claim 9, further comprising the step of:

removing the protective strip from the cradle after the cartridge is inserted therein.

11. The method of claim 9, wherein said protective strip is formed of substantially smooth, self supportive, non-magnetic material having a length of at least 12 cm and a width of 2 to 3 cm.

12. The method of claim 11, wherein said strip is formed with a thickness between 0.2 and 0.3 mm.

13. The method of claim 11, wherein said strip is made of plastic material.

14. The method of claim 11, wherein said protective strip is removed from a package along a separation line defining the shape of the strip and thereafter inserted into the cradle.

15. The method of claim 14, wherein said separation line is formed by perforations.

16. The method of claim 14, wherein said separation line is formed by a reduced thickness of material.

* * * * *